US006249091B1

(12) United States Patent
Belliveau

(10) Patent No.: US 6,249,091 B1
(45) Date of Patent: Jun. 19, 2001

(54) SELECTABLE AUDIO CONTROLLED PARAMETERS FOR MULTIPARAMETER LIGHTS

(76) Inventor: Richard S. Belliveau, 10643 Floral Park, Austin, TX (US) 78759

( * ) Notice: Subject to any disclaimer, the term of this patent is extended or adjusted under 35 U.S.C. 154(b) by 0 days.

(21) Appl. No.: 09/566,763

(22) Filed: May 8, 2000

(51) Int. Cl.[7] ..... H05B 37/00

(52) U.S. Cl. ..... 315/312; 315/316; 315/362; 362/85; 340/825.24

(58) Field of Search ..... 315/149, 154, 315/292, 295, 312, 316, 362; 362/85, 233, 239; 340/825.22, 825.24

(56) References Cited

U.S. PATENT DOCUMENTS

| | | | | |
|---|---|---|---|---|
| 3,635,121 | | 1/1972 | Knauff | 84/464 |
| 3,720,939 | * | 3/1973 | Polanek et al. | 340/815.46 |
| 4,392,187 | * | 7/1983 | Bornhorst | 362/233 |
| 4,394,656 | | 7/1983 | Goettsche | 340/825.73 |
| 4,408,308 | | 10/1983 | Smith et al. | 367/197 |
| 4,440,059 | * | 4/1984 | Hunter | 84/464 R |
| 4,621,557 | | 11/1986 | Newell | 84/1.19 |
| 4,753,148 | | 6/1988 | Johnson | 84/464 |
| 5,023,517 | | 6/1991 | Husak | 315/200 |
| 5,083,064 | | 1/1992 | Jones, Sr. | 315/294 |
| 5,140,304 | | 8/1992 | Miller | 340/472 |
| 5,209,560 | | 5/1993 | Taylor et al. | 362/85 |
| 5,493,281 | | 2/1996 | Owens | 340/825.24 |
| 5,896,457 | | 4/1999 | Tyrrel | 381/56 |
| 5,921,659 | | 7/1999 | Hunt et al. | 362/233 |
| 6,166,496 | * | 12/2000 | Lys et al. | 315/316 |

OTHER PUBLICATIONS

"Trackspot User Manual"; ftp://ftp.highland.com/pub/Products/Trackspot/manual/tsv1.pdf.

* cited by examiner

*Primary Examiner*—Haissa Philogene
(74) *Attorney, Agent, or Firm*—Walter J. Tencza, Jr.

(57) ABSTRACT

Individual variable parameters of a multiparameter lighting device may be varied in response to a processed audio signal. The multiparameter lighting device is equipped with an audio transducer to receive sound waves in the vicinity of the device. The audio signal generated by the transducer in response to the sound waves is sent to a signal processor where the audio signal is processed and converted to a control signal for varying selected parameters of the multiparameter lighting device. The multiparameter lighting device is operated remotely from a control device using a digital communication scheme. An operator of the control device may remotely select which parameter of the multiparameter lighting device may be varied in response to the processed audio signal. One or several parameters may be varied in response to the processed audio signal. The intensity of the light source may also be varied in response to the processed audio signal.

29 Claims, 5 Drawing Sheets

SELECTABLE AUDIO CONTROLLED PARAMETERS FOR MULTIPARAMETER LIGHTS

FIELD OF THE INVENTION

The invention relates to stage lighting and more particularly multiparameter lights with remote controlled parameters.

BACKGROUND OF THE INVENTION

Stage lighting instruments may be used in theatre, rock concerts, restaurants, nightclubs, or special events. Multiparameter stage lighting instruments or devices are typically comprised of a light source and one or more parameters that may be controlled by an operator through a control device. U.S. Pat. No. 4,392,187 to Bohnhorst, which is incorporated by reference and which is titled: "Computer controlled lighting system having automatically variable position, color, intensity and beam divergence," describes multiparameter lighting devices and a central control device. Multiparameter lighting devices may offer several variable parameters such as pan, tilt, color, pattern, iris and focus. Multiparameter lighting devices are often controlled by a remote control device under the direction of an operator. The remote control device is typically hardwired to the multiparameter lighting devices through communication lines and there is "remote" control in the sense that the multiparameter lighting devices may be at distant locations. An operator may program the control device to produce a show with the multiparameter lighting devices.

The shows programmed by the operator may consist of twenty or more multiparameter lighting devices. Each multiparameter lighting device may have as many as eight to twelve parameters that may be varied to produce a desired lighting effect. The parameters to be varied are selected by an operator of the remote control device. The operator may program the multiparameter lighting devices from the control device to produce a "scene". A scene is produced by varying the parameters for each of the multiparameter lighting devices as to produce a desired effect. In the prior art within a scene a particular multiparameter lighting device will have its parameters set in a particular manner, for example the color may be set to "red", the tilt may be set to ninety degrees, the pattern may be set to a circular pattern, etc.

Each scene for the total of the twenty or more multiparameter lighting devices may take the operator of the control device considerable time to program. For each scene the average of twenty multiparameter lighting devices often comprised of eight to twelve parameters each, results in a large amount of options for the operator. The final result of the show that utilizes twenty or more multiparameter lighting devices may have fifty to one hundred scenes where each scene contains hundreds of parameters of many multiparameter lighting devices that are varied.

The operator of the control device may spend considerable time programming the show using the control device. Sometimes the show rehearsal times do not allow enough time for the operator to be as creative as they would like. With so many parameters available from each multiparameter lighting device, it can be very time consuming for the operator to address each one. ("Addressing" typically requires an operator of the control device to identify by operator inputs the"address" or unique identification for a particular multiparameter lighting device, and then after the address signal has been sent, allows the operator through additional operator inputs to specify each parameter of the multiparameter lighting device).

For instance, to set the color parameter of a multiparameter light may require setting a color wheel to a particular rotational position (a color wheel may typically have eight apertures one for each color) which is located on the multiparameter lighting device. The color wheel of a multiparameter lighting device may index from one color (one rotational position) to another when a color change command is received from the control device. If the operator wants to sequence several colors from the wheel to be placed in the light path he normally must program a separate scene for each color to be presented into the light path. Next, the scenes of selected colors are sequenced at the control device by the operator. The operator may "play back" the programmed scenes (that he programmed) sequentially by inputting a command to the control device or by a signal from the control device. The prior art multiparameter lighting devices do not typically store the "scenes" or if they are stored they are pre-stored as in the prior art TRACKSPOT (registered trademark) device at a factory. The TRACKSPOT (registered trademark) device is disclosed in TRACKSPOT (registered trademark) User Manual, copyright High End Systems, Inc. 1997, P/N 60600034, Version 4.1 which is incorporated by reference. The control device, which is located remotely, sends control signals which cause the scenes to sequence. The programming of the show, with its corresponding scenes, can be very time consuming for the operator, as each multiparameter lighting device might be individually addressed and its many parameters varied.

In order to reduce the programming time that the operator requires to be creative, manufactures of multiparameter lighting devices have included various additional commands for many of the parameters. These various additional commands might be considered as macros. A color wheel utilized by the multiparameter lighting device may most often respond to indexing commands that are sent to the light from the control device. An indexing command allows the operator to choose which color is to be placed in the light path of the multiparameter lighting device. The various additional commands or macros may include random color at a fast change speed, random color at a slow change speed, color spin at a fast change speed (the color wheel rotates continuously), color spin at a slow change speed. By selecting one of the color parameter macros, the operator can save the programming time necessary to create something similar that might be accomplished using multiple scenes with the corresponding required indexing commands.

As another example, a mechanical shutter parameter used to blackout the light emitted by the multiparameter lighting device, may not only be programmable "on or off" but different actions of the shutter may also be chosen. This means for a stroboscopic effect where the shutter may open and close several hundred times, the operator need not program the shutter to open and close several hundred times by programming several hundred scenes that sequence. Instead the operator may communicate from the control device to the multiparameter lighting device a macro command that operates from the operating memory of the multiparameter lighting device. This macro command may provide the repetitive opening and closing of the shutter necessary to create the stroboscopic effect.

The operator of the control system may implement several macros in to each scene during the programming of the show. Many multiparameter lighting devices may have several macros available per parameter. The macro commands available affect the parameters of the multiparameter lighting device, save the operator time and allow for greater creativity.

After programming the show on the control device, the show containing all the scenes and corresponding parameters for each of the multiparameter lighting devices is recalled from the control device's memory. The scenes can be called up during the actual show by the operator who may be present at the control device during the show or they might be synchronized to a timer, so that they are automatically called up during the show. If the scenes are called up by the operator during the show, it is important that the correct scene be called up at the correct moment during the show. During a musical or a rock concert, the operator may call up scenes precisely in time with a climactic musical score. This offers the audience of the show a sense that the lighting is tracking or responding to the show.

Various methods of controlling a show to audio without the operator precisely keeping time with a musical score have been tried in the prior art. Control systems such as the High End Systems INTELLABEAM (trademarked) controller as illustrated in the High End Systems All Product Brochure have included an audio input to the control device. An audio signal is provided to the audio input of the control device. This audio input is converted to a control signal that is used to advance a scene that has already been programmed by an operator. Several scenes may be advanced as an audio signal is received at the input of the control device. Unfortunately this prior art method of advancing the scenes to audio only advances the preprogrammed scenes and whatever parameters have changed due to the programming of the scenes.

At least one manufacture has included a transducer or microphone within the multiparameter lighting device housing to detect an audio signal. The TRACKSPOT (trademarked) multiparameter lighting device as illustrated in the High End Systems All Product Brochure is equipped with a microphone for advancing scenes when one of the multiparameter lighting devices is selected as a "master unit". The master unit converts the audio signal received by the microphone and utilizes the converted signal to advance the preprogrammed scenes contained within the master's memory. The master in turn advances the scenes of the rest of the multiparameter lighting devices that are on the same communication system visually simultaneously with the audio advance signal received by the master. This prior art audio advance system is limited as it only advances the preprogrammed scenes to a processed audio signal. An operator cannot program a scene at the control system and select a parameter of an individual TRACKSPOT (trademarked) multiparameter light to be audio responsive. The Trackspot system only advances the factory programmed scenes to the audio. When a scene is advanced the parameters of the lights in that scene are not audio responsive.

SUMMARY OF THE INVENTION

The present invention in one embodiment provides an apparatus comprising a first multiparameter lighting device, wherein the first multiparameter lighting device is comprised of a first transducer, and a first node for receiving a first digital communications signal, and a first processor.

The first transducer may change sound waves into a first audio electrical signal. The first processor may receive a digital communications signal and in response cause a first parameter of the first multiparameter lighting device to be modified in response to the first audio electrical signal. The first digital communications signal may specify the first parameter. The first digital communications signal may specify additional parameters. The parameters of the multiparameter lighting device may be the color emitted by the device, tilt of the device, a pattern of light emitted by the device, or the intensity of the light emitted by the device.

In one embodiment a control device is provided which provides the first digital communications signal. The control device may be electrically connected to the first multiparameter lighting device through one or more communication lines.

A plurality of further multiparameter lighting devices may also be provided whose parameters can be controlled by the control device. Each further multiparameter lighting device may have a sound transducer for receiving sound waves, a node for receiving a digital communications signal from the control device; and a processor for causing an individual parameter of any of the plurality of multiparameter lighting devices to be modified in response to a particular audio electrical signal. The control device may provide various digital communications signals to control the multiparameter lighting devices. The communication signals may be provided in response to operator inputs supplied at the control device.

The present invention in various a embodiment provides the ability to "remotely" select audio controlled parameters for multiparameter lighting devices. "Remotely" is used to mean where a control device is located at a different location from a multiparameter lighting device but the control device may still be hardwired to the multiparameter lighting device through communication lines. For the most part, the hard wired system is used. From time to time the wires can not be run and the hard wired communications node at the control device is plugged into a transmitter. In a wireless form, a transmitter would typically send the communications signal or signals to a receiver that outputs again to hard wire. The present invention in one embodiment allows the operator of a control device for a group of multiparameter lighting devices the ability to select audio macros for certain equipped parameters of the multiparameter lighting devices. For example, a color parameter of a multiparameter lighting device may respond to the prior art commands received from operator inputs of a control device such as color index or macros such as color spin or random color yet also respond to certain audio controlled macros. The present invention in one embodiment allows several parameters of a multiparameter light to be selected to respond to an audio signal while several others may be selected not to respond to the audio signal.

With embodiments of the present invention, a much greater dimension of control options are made available for multiparameter lighting devices. During the programming of shows that have limited programming time available, the audio controlled parameters allow the operator of the control device more creativity and as such greater productivity. Embodiments of the present invention allow an operator of the multiparameter lighting devices to select, during programming, which parameter of which light is to be responsive to audio signals.

The multiparameter lighting device of the invention can be equipped with a sound transducer such as a microphone for receiving external sound waves and converting the sound waves into one or more audio electrical signals. The audio electrical signal derived from the microphone may be amplified and the amplified audio electrical signal may be fed to an analog to digital converter as part of a signal processor. The amplifier and analog to digital converter, and other signal processing, may be integrated into a microprocessor on the multiparameter lighting device. The microprocessor processes the digital audio signal in various ways that are derived from operating software programmed in the microprocessor. For instance, the digital audio signal may be processed to remove all frequency components except the low frequencies.

The microprocessor may process the audio signal to remove all frequency components except the midrange audio frequencies. The processed midrange information may be used by the microprocessor to effect changes to the parameters of the multiparameter lighting device controlled by the processor. The microprocessor may omit all frequency components except the low frequency components. The low frequency information might be processed by the microprocessor to effect changes to the selected parameters of the multiparameter lighting device controlled by the microprocessor.

The operator of the control device may start by programming a scene. The creation of the scene may involve the programming of several multiparameter lighting devices and their parameters. One of the multiparameter lighting devices is addressed by the control device under the guidance of an operator as it has been in the prior art. The operator may select from the addressed multiparameter lighting device a parameter to control. For instance, the operator may select to control the color parameter. With the multiparameter lighting device of embodiments of the present invention, the color command set for the color parameter of a particular multiparameter lighting device might include one or several audio macros that affect the color parameter. The control device would tell a multiparameter lighting device which audio macro is to be executed in response to which audio signal inputs.

BRIEF DESCRIPTION OF THE INVENTION

DETAILED DESCRIPTION OF THE DRAWINGS

Figure 1:
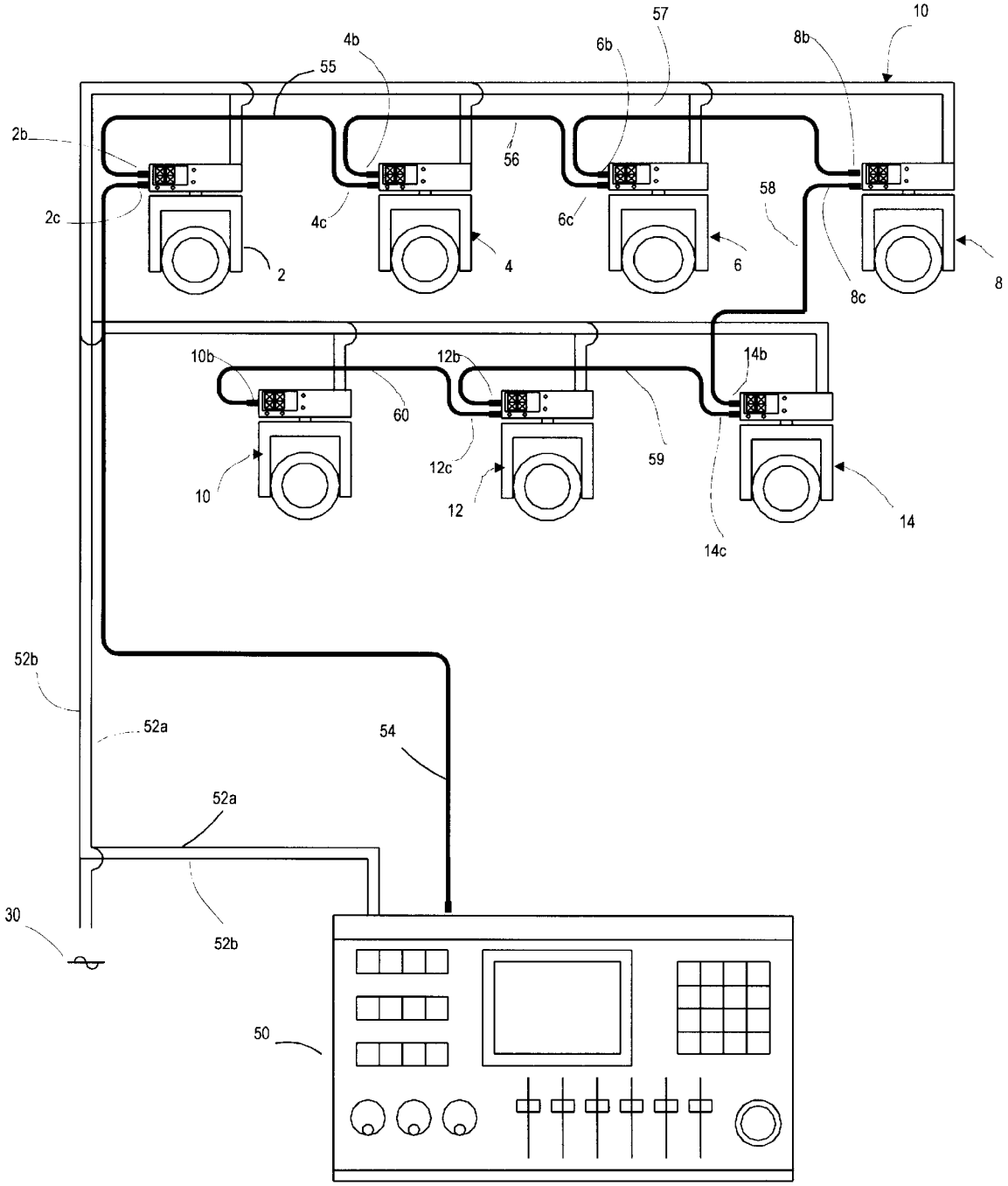
Fig. 1 (Prior Art)
FIG. 1 illustrates a typical multiparameter light system of the prior art.

FIG. 1 illustrates a typical multiparameter light system 10 of the prior art. A control device 50 is shown that is used to program the parameters of a plurality of multiparameter lighting devices 2, 4, 6, 8, 10, 12, and 14. The control device 50 and the multiparameter lighting devices 2 through 14 are connected to the power source 30 (which may be an alternating current "AC" power source) through power lines 52*a* and 52*b*. Although seven multiparameter lighting devices 2–14 are shown, typical systems may consist of twenty or more of such multiparameter lighting devices.

A digital communication line comprised of a plurality of communication lines is illustrated. Digital communication line 54 (which may be a communications bus comprised of two or more wires) is connected to control device 50 and to the communications input 2*c*. Digital communication line 55 is electrically connected to communications output 2*b* and to communications output 4*c*. Digital communication lines 56, 57, 58, 59, and 60 are electrically connected to communications output 4*b* and communications input 6*c*, communications output 6*b* and communications input 8*b*, communications output 8*c* and communications input 14*b*, communications output 14*c* and communications input 12*b*, and communications output 12*c* and communications input 10*b* respectively. The digital communication lines 54–60 transmit control information from the control device 50 to the multiparameter lighting devices 2–14, such as control information for controlling all available parameters of each of the multiparameter lighting devices 2–14 such as for example, but not limited to pan, tilt, color, shutter, pattern and focus.

Figure 2A:
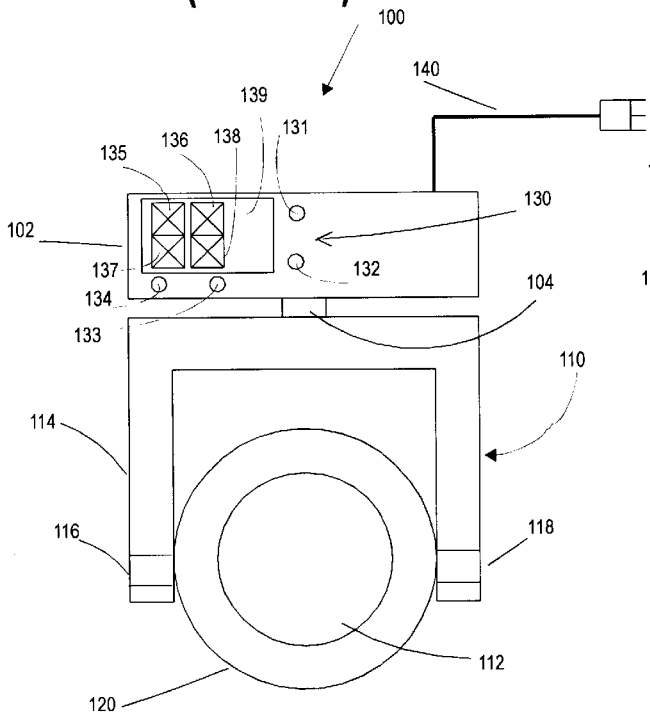
Fig. 2A (Prior Art)
FIG. 2A illustrates the general appearance of a prior art type of multiparameter lighting device.

FIG. 2A illustrates a prior art multiparameter lighting device 100. The multiparameter lighting device 100 includes a base 102, a bearing 104, a yoke 114, bearings 116 and 118, and lamp housing 120.

The lamp housing 120 is connected to the yoke 114 by bearings 116 and 118 which are shown in simplified form. The yoke 104 is connected to the base 102 by bearings 104 shown in simplified form.

The lamp housing 120 includes an aperture 112 for light to be emitted from the lamp housing 120. The lamp housing 120 houses various electronic, mechanical and optical parts. The external parts shown in FIG. 2A are known in the prior art. The present invention will introduce new internal parts or new operation of internal parts such as will be shown and described with reference to FIG. 3C into the prior art structure of FIG. 2A.

Figure 2B:
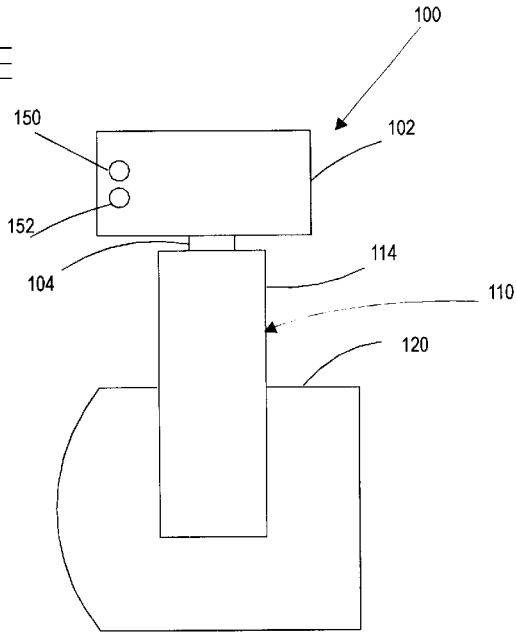
Fig. 2B (Prior Art)
FIG. 2B illustrates a side view of the prior art multiparameter lighting device described in FIG. 2A.

The base 102 typically houses electronic circuitry for controlling positioning of the lamp housing 120. The lamp housing 120 may be "positioned" by remote control ("positioning" means control of "tilt" and "panning"). "Tilting" the lamp housing 120 refers to tilting the lamp housing 120 about bearings 116 and 118 with respect to the yoke 114; "panning" the lamp housing 120 refers to panning the yoke 114, and thus the lamp housing 120, about the bearings 104 with respect to the base 102. The "positioning" of the lamp housing 120 can thus be controlled with at least these two parameters. The base 102 includes a display and keypad device 130. The display and keypad device 130 includes buttons 131–134 and Light Emitting Diode Displays 135–138. The buttons 131–134 are input devices to allow on board control of the various parameters for such things as setting the address of a multiparameter lighting device (such as device 100) and for performing tests on the parameters (such as pan, tilt, etc). The LED displays 135–138 (or a lesser number of such LEDs) are shown in simplified form and are typically used to display the address information as well as service information for the multiparameter lighting device 100. The base 102 includes input (152) and output (150) communications connections (which are shown in FIG. 2B) for connecting to in and out electronic communications lines.

The display and keypad device 130 is used to select a communications address for the multi-parameter lighting device 100. By using the display system and keypad 130 the multi-parameter lighting device 100 (and any similar multiparameter lighting device) may be given a unique address so that the multiparameter lighting device 100 may respond separately to commands from a control device (not shown but may be control device 50 as in FIG. 1) over a communication system (not shown but may include for example communications lines 54 through 60 in FIG. 1) for the unique address, is recognized by the multiparameter lighting device 100. The unique address is set for each multiparameter lighting device such as device 100, by using the input buttons on the display and keypad device, such as 130. The unique address is set to be different from the other multiparameter lighting devices used in a show and possibly referenced by the location as seen by the operator. For instance the first multiparameter lighting device such as device 2 in FIG. 1, closest to the operator in the show may be set as address one.

A power cable with plug 140 is also shown in FIG. 2A for plugging into a standard electrical power outlet.

The display and keypad device 130 may also be used to control the parameters of the multiparameter lighting device 100 directly without the need for a control device. The localized control of the multi-parameter lighting device 100 by utilizing the display and keypad device 130 may be used for small shows or events where a control device may not be cost effective.

FIG. 2B shows a side view of the multiparameter lighting device 100.

Figure 3A:
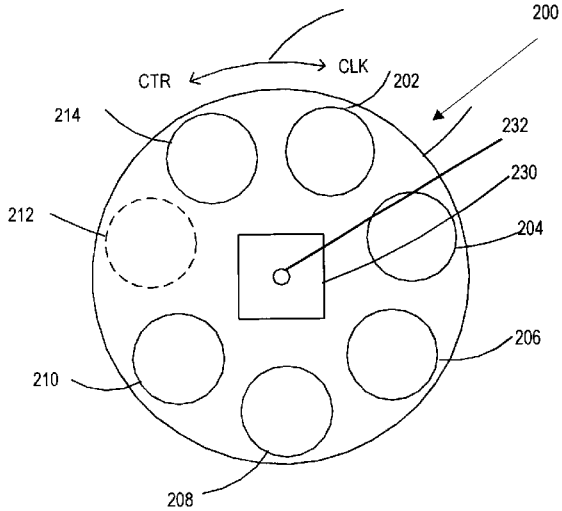
FIG. 3A illustrates a color wheel of the prior art. Shown are several color apertures, a motor and the color wheel.

FIG. 3A shows a back view of a color wheel 200 of the prior art. The color wheel 200 includes apertures 202, 204, 206, 208, 210, 212, and 214. The aperture 212 is shown in dashed lines because aperture 212 has no color and freely passes the white light from a lamp, such as lamp 354 in FIG. 3C. The other apertures 202–210 and 214 may contain color filters. The color wheel 200 can be made to rotate in a clockwise CLK direction or in a counterclockwise CTR direction as shown in FIG. 3A through the use of a motor 230 which has a shaft 232 connected to the color wheel 200.

Figure 3B:
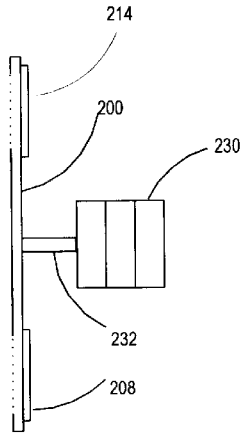
FIG. 3B is a side view of the color wheel described in FIG. 3A.

FIG. 3B is a side view of the color wheel 200 and the motor 230 and shaft 232 described in FIG. 3A.

Figure 3C:
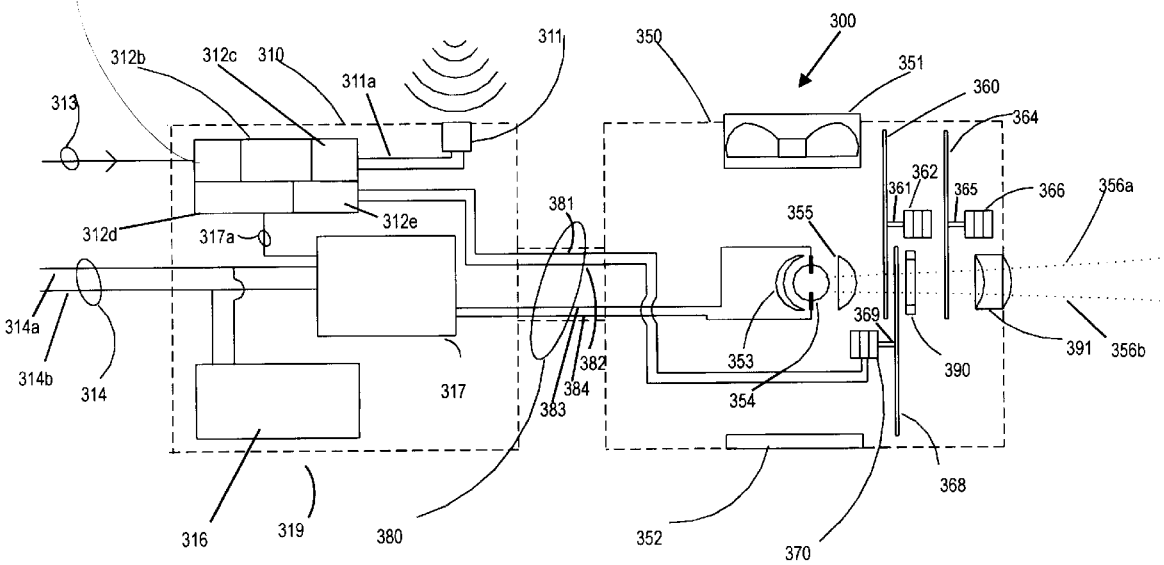
FIG. 3C illustrates a multiparameter lighting device of an embodiment of the present invention.
Figure 4:
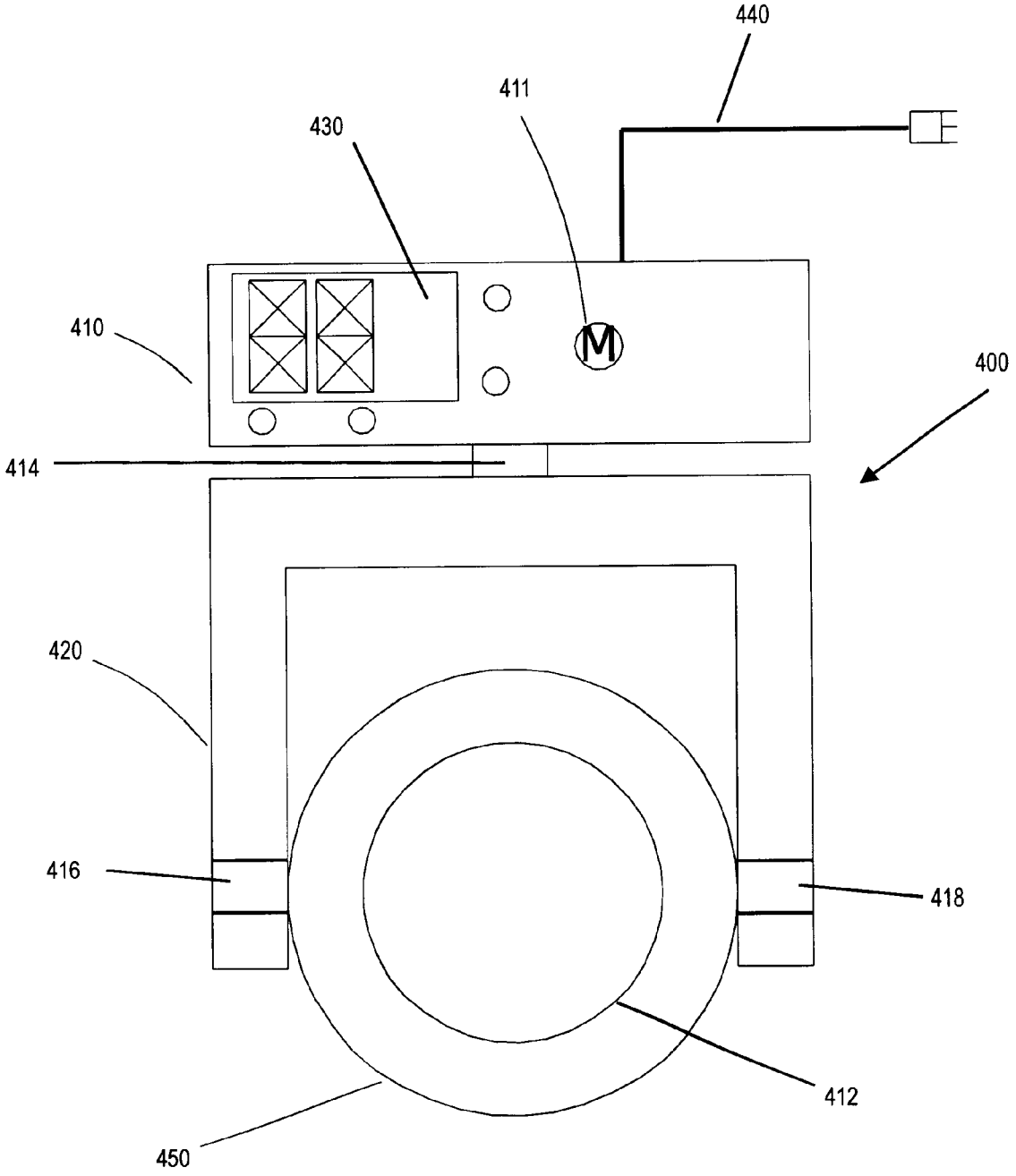
FIG. 4 illustrates a multiparameter lighting device of an embodiment of the present invention.

FIG. 3C illustrates a multiparameter lighting device 300 of an embodiment of the present invention. (FIG. 3C shows the internal components, FIG. 4 shows the external structure into which components of FIG. 3C can be incorporated). The multiparameter lighting device 300 includes a base 310 (which may include electronics housing and corresponds to base 410 in FIG. 4) and a lamp housing 350 (which may correspond to lamp housing 450 of FIG. 4). The base 310 is connected to the lamp housing 350 by a yoke (not shown, which may correspond to yoke 420 in FIG. 4), which includes an internal bearing assembly 380 which has wires 381, 382, 383, and 384 running through the bearing assembly. The yoke (not shown) may also be similar to the yoke 114 of the prior art in FIG. 2A. Not all wires running through the bearing assembly 380 are shown for simplification.

The base 310 includes microphone 311, logic card 312, a logic power supply 316, and a lamp power supply 317.The logic card 312 includes a communications interface 312*a*, a microprocessor 312*b*, a signal processor 312*c*, a lamp power supply output driver 312*d*, and a motor driver section 312*e*.

The logic card 312 of the base 310 is connected to communications line 313 through communications node 312*a*. The lamp power supply 317, and the logic power supply 316 of the base 310 is connected to external power cable 314, which includes wires 314*a* and 314*b* which is connected to an external power source. The external power cable 314 provides power to the multiparameter lighting device 300.

The lamp housing 350 includes a fan 351, a fan inlet port 352, a reflector 353, a lamp 354, a condensing lens 355, a light beam shown in dotted lines 356*a* and 356*b*, and optical wheels 360, 364, and 368. Optical wheel 360 is fixed to the shaft 361 which is connected to the motor 362. Optical wheel 364 is fixed to the shaft 365, which is connected to the motor 366. Optical wheel 368 is fixed to the shaft 369, which is connected to the motor 370. Optical wheels 360, 364, and 368 can be made to rotate by their respective motor. The optical parameter wheels 360, 364, and 368 can be rotated to a different position (i.e. a different aperture like one of apertures 202–214) to provide a particular color parameter or a particular pattern parameter.

The lamp housing 350 also includes an iris 390 and a focusing lens 391, each of which would be connected to its own motor not shown.

Sound waves 315 are shown going into the microphone 311.

In operation, the multiparameter lighting device 300 functions as follows. The multiparameter lighting device 300 first receives an electronic signal command from a control device (not shown but may be similar to control device 50 in FIG. 1) through communication line 313 (an electronic signal command received over communication line 313 would be a digital communications signal in accordance an embodiment of the present invention) or by receiving an input by an operator via a display and keypad device (not shown but may be similar to display and keypad device 130 shown part of base 102 in FIG. 2A) of the multiparameter lighting device 300. The microphone 311 picks up various audio signals. The microphone 311 is preferably fixed to and contained within the housing 319 (shown by dashed lines) of the base 310. The microphone 311 may of course be separate from the housing 319 and connected to the signal processor 312*c* within the housing 319 of the base 310 by wire, radio frequency or other transmission means. The audio signal is sent from the microphone 311 to the signal processor 312*c* via the signal line 311*a*. The signal processor 312*c* may contain an amplifier to amplify the audio signal. The signal processor 312*c* may contain an analog to digital converter. Various types of signal processor systems may be used to extract the desired audio information as well known in the art.

The signal processor 312*c* provides the first modified signal to the microprocessor 312*b*. The microprocessor 312*b* converts the first modified signal to create a second modified signal, which is provided to the motor driver section 312*e*. The motor drive section 312*e* then provides motor drive signals via control line lines 381 and 382 which drive the motors 362, 366, and 370 to turn the shafts 361, 365, and 369, respectively, to rotate the wheels 360, 364, and 368, respectively, in relation to the original audio signal received at microphone 311. The modifications for transforming the first modified signal into the second modified signal are stored in operational software code of the microprocessor 312*b* from which the microprocessor 312*b*, operates from.

The microprocessor 312*b* may also provide a lamp intensity modification signal to the lamp power supply output driver 312*d*. The lamp power supply output driver 312*d* may then provide a lamp driver signal via communications line 317*a*, based on the lamp intensity modification signal, to the lamp power supply 317. The lamp power supply 317 then would provide a corresponding output signal to change the intensity of the lamp 354 through lamp power lines 383 and 384.

Although FIG. 3 illustrates a multiparameter lighting device 300 with a base 310 separate from the lamp housing 350, other types of housings can be utilized such as a single housing for both the base 310 and the lamp housing 350 without the bearing assemblies.

FIG. 4 illustrates a multiparameter lighting device 400 in accordance with an embodiment of the present invention, comprised of a base 410, bearings 414, a yoke 420, and a lamp housing 450, a light aperture 412, a power cord 440, and tilt bearings 416 and 418. The multiparameter lighting device 400 may include internal components similar to the embodiment of FIG. 3C. The multiparameter lighting device 400 may include a display and keypad device 430 similar to the display and keypad device 130 shown in the prior art for FIG. 2A. A microphone 411 is shown mounted in the electronic housing.

Figure 5:
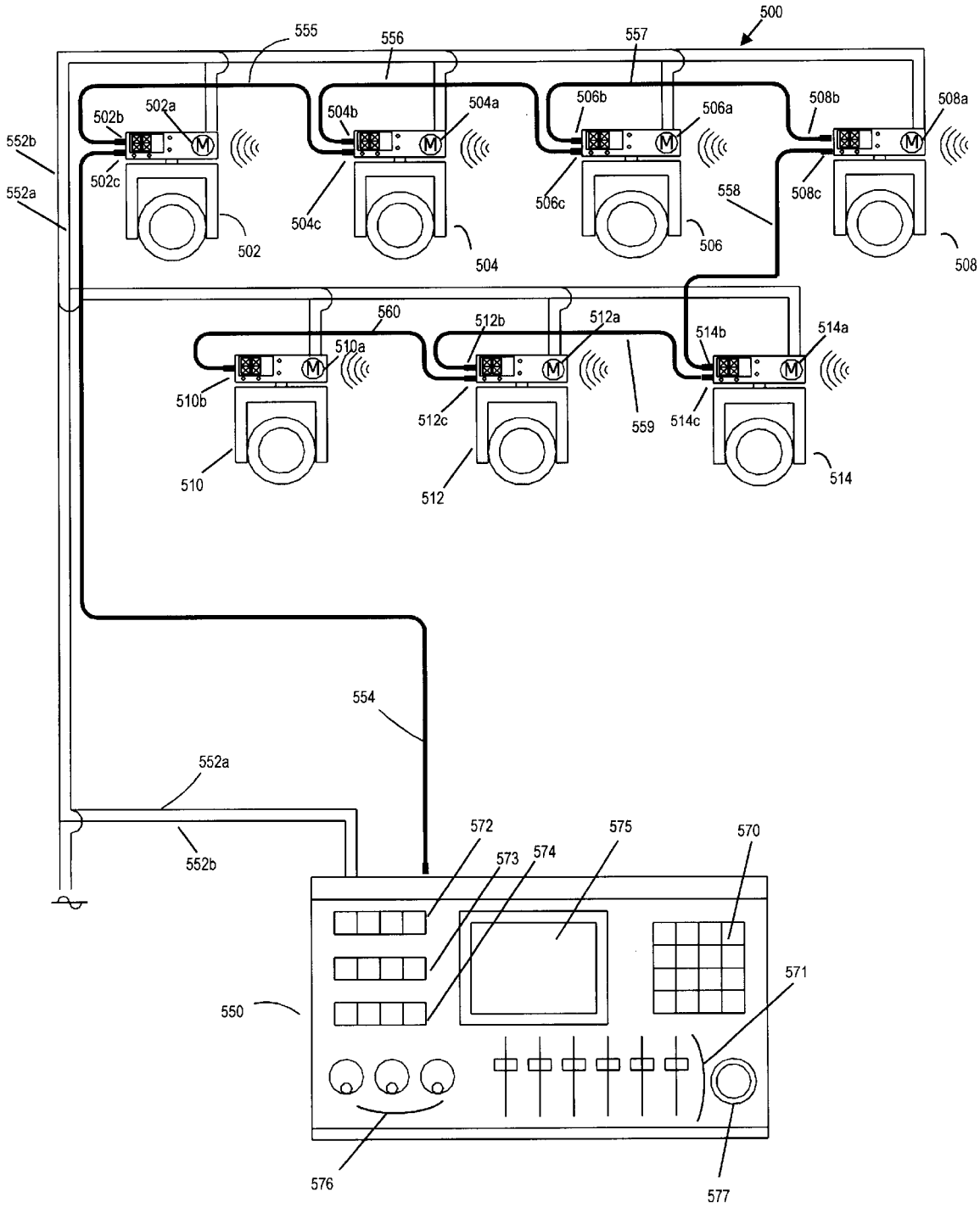
FIG. 5 illustrates a multiparameter lighting system in accordance with an embodiment of the present invention.

FIG. 5 illustrates a plurality of multiparameter lighting devices, including multiparameter lighting devices 502, 504, 506, 508, 510, 512, and 514 arranged in a multiparameter lighting system 500 that employs an embodiment of the present invention. Each of the multiparameter lighting devices may be similar to multiparameter lighting device 400 of FIG. 4 which includes internal components shown in FIG. 3C. Each of the multiparameter lighting devices may have a microphone. Multiparameter lighting device 502, 504, 506, 508, 510, 512, and 514 may have microphones 502*a*, 504*a*, 506*a*, 508*a*, 510*a*, 512*a*, and 514*a*, each of which may have the function of microphones 411 of FIG. 4 or 311 of FIG. 3C. The system 500 can be capable of selecting by remote control which of the multiparameter lighting devices (of 502 through 514) will have what particular parameter (such as color, pattern, pan, tilt etc. as mentioned previously) selected to respond to an incoming audio signal as received by the appropriate transducer microphone (such as 502*a* through 514*a*).

The multiparameter lighting system 500 includes a control device 550. The control device 550 and the multiparameter lighting devices 502–514 are each connected to power lines 552*a* and 552*b*, which may be part of an AC (alternating current) power source. The power lines 552*a* and 552*b* may be the same as the power lines 314*a* and 314*b* shown in FIG. 3C.

The control device 550 includes input devices 570–577 which are shown simplified and may be comprised of rotary encoder wheels, slider potentiometers, touch screen input devices and input switches that are well known in the prior art.

The control device 550 may be electrically connected by digital communications line 554 to communications input 502*c* of multiparameter lighting device 502. Communications input 502*c* may correspond to communications input 152 shown in FIG. 2B. A similar digital communications line 555 may electrically connect communications output 502*b* to communications input 504*c* of device 504. Similar digital communications lines 556, 557, 558, 559, and 560 may electrically connect communications output 504*b* with communications input 506*c*, communications output 506*b* with communications input 508*b*, communications output 508*c* with communications input 514*b*, communications output 514*c* with communications input 512*b*, and communications output 512*c* with communications input 510*b*.

The multiparameter lighting devices 502–514 may be electrically connected to the same power source, electrically connected to the same hardwired digital communications source (i.e. control device 550 through digital communications lines 54 through 60), and are capable in an embodiment of the present invention of receiving and responding to particular wireless audio signals.

The digital communications line 554 (and other digital communications lines 555–560) may be the same as line 313 in FIG. 3C and may connect to an input connection like connection 152 in FIG. 2B of a multiparameter lighting device such as 502.

The operation of an embodiment in accordance with FIGS. 3A, 3B, 3C, 4, and 5 will now be described. An operator of the control device 550 can first select one of the multiparameter lighting devices available, such as for example multiparameter lighting device 502 shown in FIG. 5, by selecting the appropriate input devices of 570 through 577 in a known manner to uniquely select the address of the multiparameter lighting device 502 as known in the art. The control device 550 may employ a numerical keypad as one or more of the input devices 570 through 577. Other input devices could be used such as voice, Light emitting diodes, mouse, or any other that would be known to those skilled in the art. The operator may first press a select button (which may be one of input devices 570 through 577 on control device 550) to allow the input of an address; next the operator may input the address of the multiparameter lighting device (for example 502) to be addressed by pressing the correct address number on the keypad (such as for example address 32). Next the operator may use the select button to select a parameter to be adjusted. In accordance with an embodiment of the present invention, during the adjustment of the parameter, the operator may select the parameter to function as audio responsive.

The operator would adjust the individual parameter selected, by entering an amount of adjustment on the keypad (one of devices 570–577). Next he may hit "record" (which may be one of the input devices of 570–577 on control device 550) or just select another multiparameter lighting device to be addressed.

The operator of the control system continues to address all of multiparameter lights and in turn adjusts all of their parameters to produce the desired effect. When the operator has produced the desired effect, the operator may then choose to record what they have programmed as a scene. The operator may input a designated number to record and reference the first scene to, by inputting to one of the input devices 570–577 on control device 550 as known in the art.

Next the operator may produce further scenes in the same manner as described above. In accordance with embodiments of the present invention one or more parameters of one or more multiparameter lighting devices (such as 502 through 514) may be selected as audio responsive during the scene programming process.

When the operator has produced the desired amount of scenes to create the desired effect the operator has created a show.

The programming of the scenes and overall creation of the show is usually done during a rehearsal time for the event (while the spectators are not present). When the actual event takes place, the operator may set the control system (by inputting to input devices 570–577 on control device 550 as known in the art) to sequentially step through the scenes in the order that the show was produced. The operator may choose to step through the previously produced scenes by inputting to a "next" button (by inputting to input devices 570–577 on control device 500) as known in the art.

In the prior art, a previously varied parameter of a multiparameter light may be recalled in a previously programmed scene. The varied parameter in the prior art may for example be a color wheel indexed to the red color. In the prior art the varied parameter may also be a color wheel rotation at a slow speed.

In one embodiment of the present invention the varied parameter may or may not be for example an audio responsive color wheel. With embodiments of the present invention several parameters may or may not be responsive to the received audio information in a previously programmed scene. Embodiments of the present invention provide the operator the ability to recall scenes that have previously selected parameters responding to audio. The invention can provide a single scene that may contain several multiparameter lights with several selected parameters responsive to audio. With the invention, creative, audio responsive visual changes can be viewed by the spectators of the event, yet all happen within a single scene.

Many types of actuators may be controlled by the audio electrical signal supplied by the microphone transducer (such as microphone 311 in FIG. 3C) of a particular multiparameter lighting device, such as device 300 in FIG. 3C. The audio electrical signal from the transducer microphone 311 is sent to the signal processor 312*c* where the desired audio content is sent to the microprocessor 312*b* of the multiparameter lighting device 300. Computer software routines set up in the operational code of the microprocessor 312*b* are acted upon by the microprocessor 312*b* based on the modified audio signal received from the signal processor 312*c*. The microprocessor 312*b* in turn controls the actuator also by routines set up in operational code of the microprocessor 312*b* by interfacing with the drive circuit 312*e* for the actuators. The actuators in the FIG. 3C embodiment are the three motors 362, 366, and 370 for the three corresponding shafts 361, 365, and 369, which turn the three corresponding color wheels 360, 364, and 368.

Using embodiments of the present invention the lamp intensity of a lamp, such as lamp 354 of one of the multiparameter lighting devices, such as device 300 in FIG. 3C, or a plurality of lamps may also be controlled in much the same manner. The signal processor 312*c* receives the audio signal from the sound waves picked up by the transducer microphone 311. In turn the desired audio content as formed by the signal processor 312*c* is sent to the microprocessor 312*b* of the multiparameter lighting device 300. Routines set up in the operational code of the microprocessor 312*b* are acted upon based on the audio signal received by the signal processor 312*c*. Multiparameter lighting devices 502–514 in FIG. 5 may be similar in operation and structure to multiparameter lighting device 300 in FIG. 3C.

With the invention the operator may save time during programming as the audio function assigned to a parameter acts on the parameter as a macro. Many different looks can be created as the parameter of a multiparameter lighting device, such as 502 in FIG. 5, responds to audio. During playback the operator need not precisely control the changing of individual scenes to track the audio as it is accomplished in the multiparameter lighting device 502 itself by having the audio signal vary the selected parameters within the scene that is called.

The microphone may be located in the base, or within any of the housing components. The microphone may be located external to the multiparameter light and the light may receive the signal via wires, or radio frequency.

I claim:

1. An apparatus comprising:

a first multiparameter lighting device;

the first multiparameter lighting device comprised of a first sound transducer for changing sound waves into a first audio electrical signal;

a first node for receiving a first digital communications signal;

a first processor which in response to the first digital communications signal causes a first parameter of the first multiparameter lighting device to be selected from a plurality of parameters for the multiparameter lighting device and causes the first parameter to be modified in response to the first audio electrical signal.

2. The apparatus of claim 1 wherein the first digital communications signal specifies the first parameter and causes the first parameter to be modified in response to the first audio signal.

3. The apparatus of claim 1 wherein the first digital communications signal specifies the first parameter and a second parameter and causes the first and the second parameter to be modified in response to the first audio signal.

4. The apparatus of claim 1 wherein the first parameter is the color of light emitted from the first multiparameter lighting device.

5. The apparatus of claim 1 wherein the first parameter is the intensity of light emitted from the first multiparameter lighting device.

6. The apparatus of claim 1 wherein the first parameter is a direction of light emitted from the first multiparameter lighting device.

7. The apparatus of claim 1 wherein the first parameter is a pattern of light emitted from the first multiparameter lighting device.

8. The apparatus of claim 1 further comprised of:

a second multiparameter lighting device;

the second multiparameter lighting device comprised of a second sound transducer for changing sound waves into a second audio electrical signal;

a second node for receiving a second digital communications signal;

a second processor which in response to the second digital communications signal causes a first parameter of the second multiparameter lighting device to be modified in response to the second audio electrical signal.

9. The apparatus of claim 8 wherein the first and second digital communications signals specify the corresponding first parameters of the respective first and second multiparameter lighting devices and cause the corresponding first parameters to be modified in response to the corresponding first and second audio electrical signals.

10. The apparatus of claim 8 wherein the first and second digital communications signals specify the first parameter and a second parameter of the respective first and second multiparameter lighting device and cause the corresponding first and the second parameters to be modified in response to the corresponding first and second audio electrical signals.

11. The apparatus of claim 8 wherein first parameter of each of the first and second multiparameter lighting devices is the color of light emitted from the corresponding first and second multiparameter lighting devices.

12. The apparatus of claim 8 wherein the first parameter of each of the first and second multiparameter lighting devices is the intensity light emitted from the corresponding first and second multiparameter lighting devices.

13. The apparatus of claim 8 wherein the first parameter of each of the first and second multiparameter lighting devices is a direction of light emitted from the corresponding first and second multiparameter lighting devices.

14. The apparatus of claim 8 wherein the first parameter of each of the first and second multiparameter lighting devices is a pattern of light emitted from the corresponding first and second multiparameter lighting devices.

15. The apparatus of claim 1 further comprised of:

a control device which provides the first digital communications signal.

16. The apparatus of claim 15 wherein the control device provides the first digital communications signal in response to an operator input supplied at the control device.

17. The apparatus of claim 8 further comprised of:

a control device which provides the first and second digital communications signals.

18. The apparatus of claim 17 wherein the control device provides the first and the second digital communications signals in response to respective first and second operator inputs supplied at the control device.

19. The apparatus of claim 15 further comprised of a communications line which electrically connects the control device with the first multiparameter lighting device.

20. The apparatus of claim 17 further comprised of:

one or more communication lines which electrically connect the control device with the first and the second multiparameter lighting devices.

21. The apparatus of claim 1 wherein the first sound transducer is a microphone.

22. The apparatus of claim 1 wherein the plurality of parameters of the first multiparameter lighting device include color, pan, tilt, pattern, and intensity.

23. A method comprising the steps of:

receiving a digital communications signal;

receiving sound waves;

converting the sound waves to a first audio electrical signal;

setting a parameter of a multiparameter lighting device based on the digital communications signal and the first audio electrical signal.

24. The method of claim 23 wherein the digital communications signal is received from a control device which is electrically connected; to the multiparameter lighting device.

25. The method of claim 23 wherein the digital communications signal provides information which uniquely identifies the multiparameter lighting device.

26. An apparatus comprising:

a first multiparameter lighting device;

the first multiparameter lighting device comprised of a first sound transducer for changing sound waves into a first audio electrical signal;

a first node for receiving a first digital communications signal;

a first processor which in response to the first digital communications signal causes a first parameter of the first multiparameter lighting device to be selected from a first set of a plurality of parameters for the first multiparameter lighting device and causes the first parameter to be modified in response to the first audio electrical signal;

and wherein the first multiparameter lighting device has a second set of a plurality of parameters which includes color, pan, tilt, pattern, and intensity.

27. The apparatus of claim 26 wherein the first set of a plurality of parameters for the first multiparameter lighting device is a subset of the second set of a plurality of parameters for the first multiparameter lighting device.

28. The apparatus of claim 26 wherein the first set of a plurality of parameters for the first multiparameter lighting device is the same as the second set of a plurality of parameters for the first multiparameter lighting device.

29. An apparatus comprising:

a first multiparameter lighting device which includes a first set of a plurality of parameters which include pan, tilt, color, pattern, and intensity, wherein a subset of the first set of a plurality of parameters can be selected by a first audio signal;

a second multiparameter lighting device which includes a second set of a plurality of parameters which include pan, tilt, color, pattern, and intensity, wherein a subset of the second set of a plurality of parameters can be selected by a second audio signal; and a control device which controls the first set of a plurality of parameters of the first multiparameter lighting device and the second set of a plurality of parameters of the second multiparameter lighting device.

* * * * *